United States Patent [19]
Colwell

[11] 4,231,714
[45] Nov. 4, 1980

[54] HYDRAULIC PUMP SYSTEM

[76] Inventor: William W. Colwell, 110 Windsor, George, Wash. 99824

[21] Appl. No.: 3,252

[22] Filed: Jan. 15, 1979

[51] Int. Cl.³ ..... F04B 9/00
[52] U.S. Cl. ..... 417/229; 417/521
[58] Field of Search ..... 417/229, 362, 521

[56] References Cited

U.S. PATENT DOCUMENTS

| | | | |
|---|---|---|---|
| 1,391,503 | 9/1921 | Register | 417/229 |
| 2,285,082 | 6/1942 | Bolt | 417/229 X |
| 2,333,614 | 11/1943 | Boyd | 417/229 |

*Primary Examiner*—Billy J. Wilhite
*Attorney, Agent, or Firm*—Wells, St. John & Roberts

[57] ABSTRACT

A pump system for high pressure hydraulic applications. A series of longitudinally spaced single acting pumps are sequentially actuated by rolling heavy weights that are moved about an endless upright track assembly by gravity assisted by operation of a prime mover. The track assembly includes an elongated inclined ramp, a horizontal base, and a relatively steep return arranged in a triangular supporting structure for an endless conveyor. The conveyor mounts a plurality of longitudinally spaced weight assemblies, which are arranged transversely between supporting endless chains. A series of pumps are mounted on the frame in fixed positions with their single acting actuators in the path of elements moved in unison with the conveyor. The pumps are preferably spaced apart a distance substantially less than the spacing between the weight assemblies and the spacing between adjacent weight assemblies is preferably not an even multiple of the spacing between the pump mechanisms.

7 Claims, 4 Drawing Figures

HYDRAULIC PUMP SYSTEM

BACKGROUND OF THE INVENTION

This invention relates to energy conversion systems, and particularly to a system for converting electrical or fossil fuel energy to a high pressure hydraulic system. This is achieved by use of conventional reciprocating pumps of relatively simple manufacture, which are actuated by an endless conveyor that supports heavy weight assemblies as the weight assemblies move about an upright path.

It is well known that the highest ranges of hydraulic pressure are achievable by use of reciprocating pumps. However, reciprocating pumps have the disadvantage of being pulsating in operation, and it is therefore necessary to utilize several such pumps operated sequentially in order to smooth out the resulting fluid flow. This can be achieved by multiple prime movers and interconnecting drive linkages, but it is recognized that this involves substantial mechanical complications and upkeep. The present arrangement is designed to provide a common drive system for a plurality of conventional single acting reciprocating pumps, whereby the pumps are efficiently utilized in a parallel hydraulic circuit leading from a low pressure source of hydraulic fluid to a high pressure discharge manifold.

It is one object of this invention to provide a smooth running drive between a rotating prime mover and reciprocating or oscilating pump actuators which makes maximum use of gravitational and inertial forces during the transmission of energy and its ultimate conversion required to pressurize hydraulic fluid.

Another object of this invention is to provide an efficient energy conversion system utilizing relatively inexpensive conventional single acting reciprocating pumps.

DESCRIPTION OF THE PREFERRED EMBODIMENT

Figure 1:
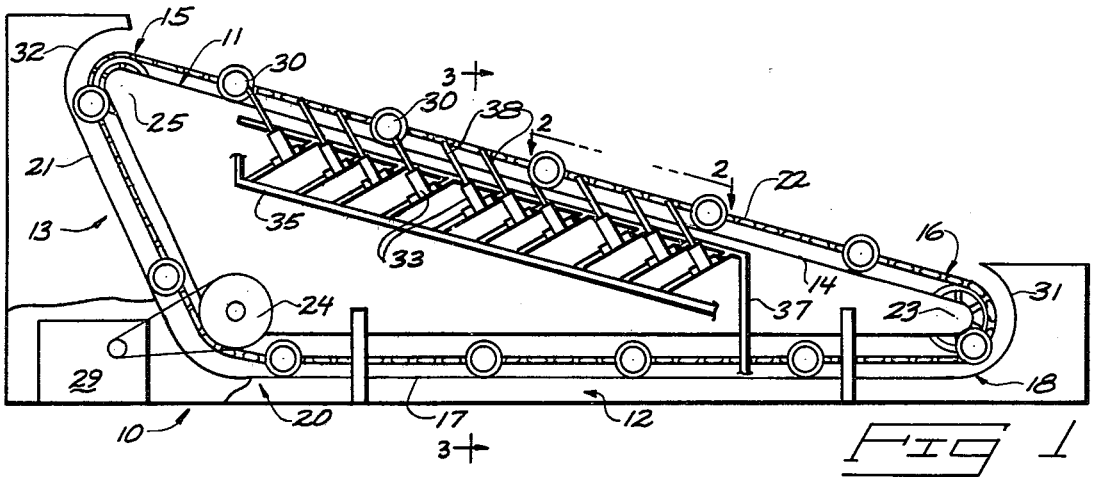
FIG. 1 is a diagrammatic side elevation view of the apparatus.
Figure 2:
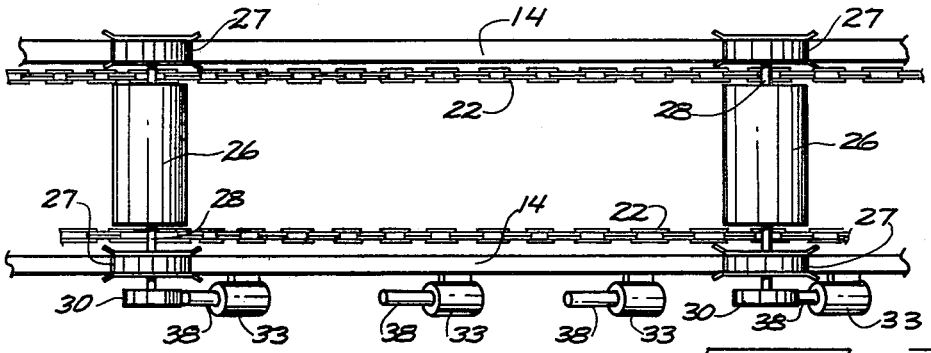
FIG. 2 is an enlarged diagrammatic top view of the apparatus as seen along line 2—2 in FIG. 1.
Figure 3:
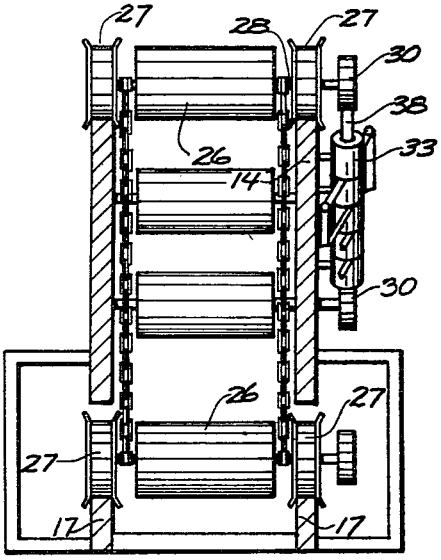
FIG. 3 is a diagrammatic sectional view of the apparatus as seen along line 3—3 in FIG. 1.
Figure 4:
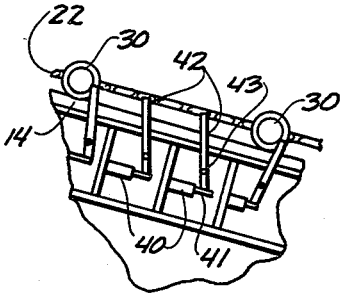
FIG. 4 is a fragmentary side elevation view of the inclined ramp, showing a second type of pump.

FIGS. 1 through 3 schematically illustrate the basic details of the present hydraulic pump system. A modification in the pump mechanism is shown in FIG. 4.

The apparatus is mounted to an upright stationary frame 10 which includes an inclined ramp 11, a horizontal base 12, and an interconnecting return 13. The inclination of the return 13 is substantially greater than that of the ramp 11. The ramp 11, base 12, and return 13 form a triangular structure about which an endless conveyor is guided for transmission of dynamic energy.

The inclined ramp 11 comprises a pair of transversely spaced tracks 14 having upwardly facing plane surfaces for conveyor guidance purposes. The upwardly facing tracks 14 extend between a first or upper end 15 and a second or lower end 16. The elevation of the first end 15 is higher than that of the second end 16.

The base 12 comprises a pair of horizontal tracks 17 having upwardly facing support surfaces in vertical alignment beneath the tracks 14. One end 18 of the tracks 17 extends from a location directly beneath the second end 16 of the inclined ramp 11. Their remaining ends 20 terminate short of a location beneath the first end 15 of the inclined ramp 11.

The return 13 comprises a pair of relatively steep upright tracks 21 aligned with the tracks 17 and 14. They extend from the end 20 of tracks 17 to a location outwardly adjacent from the first end 15 of the tracks 14. The tracks 14, 17 and 21 provide elevational support for conveyor members moving about the stationary triangular frame 10.

The endless conveyor as illustrated comprises a pair of conventional drive chains 22 arranged in side by side endless loops about the elements of frame 10. The chains 22 are entrained by sprockets 23, 24 and 25 at the respective ends of the inclined ramp 11, base 12, and return 13. The sprockets 23, 24, 25 guide the flights of chains 22 about a triangular endless path corresponding to the geometry of the frame 10. In the illustrated embodiment the operational flight of the chains 22 is arranged alongside and parallel to the inclined ramp 11, with the flights beneath flight 11 constituting a return to the first end 15 of the tracks 14. The sprockets 24 are drive sprockets for the endless conveyor and are suitably powered by an electric motor 29 or other available prime mover, such as an internal combustion engine. The sprocket 25 is rotated continuously by motor 29 through conventional power transmission means, which might be a gear drive, a chain and sprocket drive, a belt drive, or other type of speed reduction transmission capable of providing adequate power to the chains 22 to operate the system described herein.

Arranged along chains 22 are a plurality of weight assemblies. The weight assemblies are equally spaced apart along the endless conveyor.

Each weight assembly comprises a transverse cylindrical weight member 26 mounted about a central transverse shaft 28 and supported by guide rollers 27. The guide rollers 27 roll about the tracks 14, 17 and 21, which provide the weight assembly with elevational support. The weight members 26 and rollers 27 are preferably fixed to shaft 28 so as to rotate in unison with one another, although weight members 26 may be rotatably supported on shaft 28 if desired. Rotation of the weight members 26 provides additional inertia in the continuously moving system.

One end of each shaft 28 rotatably supports a coaxial end roller 30 located outwardly adjacent the frame 10. The end rollers 30 are located in a common plane and also travel in an endless triangular path about the frame 10 in unison with the supporting shafts 28 and chains 22.

At the second end 16 of the inclined ramp 11 there are provided a pair of lower track extensions 31 which curve upwardly from the end 18 of the horizontal track 17 within the base 12. Similar curved extensions 32 are provided above the upper end of the upright tracks 21 within the return 13. The extensions 32, 31 provide transitional support for the guide rollers 27 as they move onto and from the respective ends 15, 16 of the upwardly facing tracks 14 along inclined ramp 11.

The hydraulic pump mechanism comprises a plurality of identical reciprocating pumps 33 fixed to the frame 10 along the length of the inclined ramp 11. Each pump 33 basically includes a reciprocating ram connected to an external piston and located within an encircling cylinder or casing. The pumps 33 include conventional inlet and outlet connections, which typically comprise check valves controlling the direction of liquid movement relative to the interior of the pump casing. The inlets of the pumps 33 are hydraulically in communication with a common inlet conduit 35 supplied with hydraulic fluid from a suitable source, such as the low pressure reservoir (not shown). The outlets of the pumps 33 are connected in parallel to a common discharge manifold 37. The outlet of the manifold 37 can be connected by a hose or conduit to the apparatus that is to be operated by the high pressure hydraulic fluid supplied from the pump mechanism.

In FIGS. 1 through 3, the pump pistons 38 each have outer ends which intersect the path of movement of the end rollers 30 about the frame 10. The freely rotatable end rollers 30 selectively abut the pistons 38 and push them inwardly to exert fluid pressure upon the hydraulic fluid within the respective pump casings. The pistons 38 are single acting pump actuators, and are returned to their original extended positions by interior or exterior springs or other conventional pump arrangements for this purpose.

In order to smooth the flow of high pressure fluid at the outlet of the discharge manifold 37, the identical pumps 33 and single acting actuators in the form of pistons 38 are identically supported on frame 10 and are spaced along the length of the inclined ramp 11 by equal spacings between them. The spacing between adjacent pumps 33 is substantially less than the spacing between adjacent weight assemblies along the endless conveyor. Furthermore, the spacing between the adjacent weight assemblies is not an even multiple of the spacing between the adjacent pumps 33. Thus, the operation of pumps 33 will be staggered along the length of the inclined ramp 11, and no two pumps 33 will be in the identical operational sequence at any given time. By providing an adequate number of pumps 33, the fluctuation in pressure at discharge manifold 37 can be greatly minimized and a much more even high pressure head can be produced for operation of hydraulic devices requiring low volume and high pressure.

The present apparatus is adapted for continuous operation. The motor 29 rotates the drive sprockets 24 to impart sufficient power to the endless conveyor to assure continuous movement of the weight assemblies about the triangular frame 10. Once the device has been brought up to operational speed, very little power is required to lift the relatively heavy weight members 26, since the weight of the members 26 being raised along the return 33 is substantially counterbalanced by the gravitational forces imparted to the apparatus by those weight members 26 moving downwardly along the inclined ramp 11. This apparatus utilizes the gravitational and inertial forces of the heavy weight members 26 to provide a smooth energy conversion system between the constantly rotating motor 29 and the intermittently operated reciprocating pumps 33. I have found that the arrangement results in very high efficiency in energy conversion between an electric motor and a high pressure hydraulic system.

FIG. 4 shows a variation in the pump mechanism. In this variation, each pump 40 is similar to those previously described and includes a reciprocating piston 41 that again constitutes a single acting pump actuator. However, the outer end of the pistons 41 are moved inwardly through an extended pump lever 42 pivotally connected to frame 10 about a transverse pivot axis at 43. The axis of the lever 42 at 43 is parallel to the axes of the shafts 28. Again, the upper ends of the levers 42 intersect the path of the end rollers 30, which engage them directly and pivot the levers 42 in the manner illustrated in FIG. 4.

It is to be understood that the above description is only illustrative of the energy conversion system described herein and that further modifications will be obvious to those familiar with the components incorporated in the system.

Having described my invention, I claim:

1. A hydraulic pump system, comprising:

an inclined ramp having first and second longitudinally spaced ends, the first end of said inclined ramp being elevationally higher than its second end;

endless conveyor means including an upper flight guided along said inclined ramp and a return flight positioned beneath said inclined ramp;

power means operatively connected to said endless conveyor means for imparting motion thereto in a direction such that the upper flight of the endless conveyor means is moved along the inclined ramp from its first end to its second end;

a plurality of equally spaced weight assemblies mounted along the length of the endless conveyor means for integral movement therewith;

and a plurality of pump mechanisms located along the inclined ramp;

each pump mechanism being operatively connected to a common liquid supply and a common discharge manifold;

each pump mechanism further comprising a single acting actuator intersecting the path of movement of the weight assemblies along the upper flight of said endless conveyor means, whereby said pump mechanisms are sequentially actuated in response to movement of the weight assemblies along the upper flight of said endless conveyor means.

2. A hydraulic pump system as set out in claim 1 wherein the pump mechanisms are equally spaced from one another by a longitudinal spacing less than the spacing of the weight assemblies along the length of the endless conveyor.

3. A hydraulic pump system as set out in claim 2 wherein the spacing between the weight assemblies is not an even multiple of the spacing between the pump mechanisms.

4. A hydraulic pump system as set out in claim 1 wherein each weight assembly comprises:

first roller means freely mounted to the endless conveyor means about a transverse axis for free rolling engagement of the periphery of the first roller means against the inclined ramp;

and second roller means freely mounted to the endless conveyor means about a transverse axis for sequential engagement of the periphery of the second roller means and the single acting actuators of the respective pump mechanisms.

5. A hydraulic pump system as set out in claim 1 wherein each weight assembly comprises:

first roller means freely mounted to the endless conveyor means about a transverse axis for rolling engagement of the periphery of the first roller means against the inclined ramp;

and second roller means freely mounted to the endless conveyor means coaxially with respect to the transverse axis of said first roller means for sequential engagement of the periphery of the second roller means and the single acting actuators of the respective pump mechanisms.

6. A hydraulic pump system as set out in claim 1 wherein the single acting actuators of the respective pump mechanisms are pivotally mounted about a plurality of individual equally spaced transverse axes arranged along the length of the inclined ramp;

each weight assembly comprising:

roller means freely mounted to the endless conveyor means about a transverse axis parallel to the transverse axes of the single acting actuators of the pump mechanisms for sequential engagement of the periphery of the roller means and the single acting actuators of the respective pump mechanisms.

7. A hydraulic pump system, comprising:

a stationary triangular upright frame having:

(a) an inclined ramp with first and second longitudinally spaced ends, wherein the first end of the inclined ramp is elevationally higher than its second end;

(b) a base beneath the inclined ramp having one end thereof connected to the second end of the inclined ramp; and (c) a return leading from the remaining end of the base to the first end of the inclined ramp;

endless conveyor means entrained about the inclined ramp base and return of said frame;

a plurality of weight assemblies mounted to said endless conveyor means, said weight assemblies being spaced along the length of the endless conveyor means, each weight assembly including roller means rotatably mounted about parallel transverse roller axes equally spaced apart from one another along the length of said endless conveyor means;

a plurality of pump mechanisms mounted to the upright frame, each pump mechanism including a single acting actuator intersecting the path of movement of said roller means, whereby each pump mechanism is sequentially actuated by engagement between said roller means and the single acting actuator of the pump mechanism;

and power means operatively connected to said endless conveyor means for imparting continuous motion to the endless conveyor means about its path on said upright frame.

* * * * *